US005199189A

United States Patent [19]

Bourgoine et al.

[11] Patent Number: 5,199,189

[45] Date of Patent: Apr. 6, 1993

[54] WATERBASED CLEARCOAT DRYING APPARATUS

[75] Inventors: Clifford L. Bourgoine, New Durham, N.H.; Kristan M. Pierce, Howell, Mich.; Frederick J. Viles, Jr., Mashpee, Mass.

[73] Assignee: Davidson Textron Inc., Dover, N.H.

[21] Appl. No.: 908,165

[22] Filed: Jul. 2, 1992

[51] Int. Cl.[5] ..... P26B 11/00

[52] U.S. Cl. ..... 34/186; 34/187

[58] Field of Search ..... 34/184, 186, 187, 188, 34/189, 190, 236

[56] References Cited

U.S. PATENT DOCUMENTS

| | | | |
|---|---|---|---|
| 163,968 | 6/1875 | Bidwell | 34/188 |
| 523,686 | 7/1894 | Sampson | 34/188 |
| 990,749 | 4/1911 | Kretzschmar | 34/122 |
| 1,891,802 | 12/1932 | Drew | 34/187 |
| 1,934,494 | 11/1933 | Gillespie | 34/187 |
| 2,327,100 | 8/1943 | Frey | 34/122 |
| 2,403,800 | 7/1946 | Hoyler | 34/184 |
| 2,445,451 | 7/1948 | Padelford . | |
| 2,547,275 | 4/1951 | Lyon | 34/187 |
| 2,702,847 | 2/1955 | Schmidt | 34/184 |
| 2,745,191 | 5/1956 | Southerland | 34/187 |
| 3,121,039 | 2/1964 | Rowland | 34/186 |
| 3,306,426 | 2/1967 | Arnold et al. | 198/33 |
| 4,556,586 | 12/1985 | Barlow et al. | 427/282 |
| 5,012,595 | 5/1991 | Christian et al. | 34/187 |

*Primary Examiner*—Henry A. Bennet
*Assistant Examiner*—Denise Gromada
*Attorney, Agent, or Firm*—Reising, Ethington, Barnard, Perry and Milton

[57] ABSTRACT

A drying apparatus including a booth having a ferris wheel mounted therein, and a blower and heater mounted on the booth. The ferris wheel includes three pairs of rotatably mounted radially extending arms, a support plate pivotally mounted on the distal ends of the arms, adapted to hold a part which is loaded and sprayed with a waterbased clearcoat at a first position, indexed to a position directly below the blower and heater for approximately one minute to be impinged by warm air, then indexed to a third position to continue drying, before returning to the first position to be replaced by another part. The heater is a plurality of ceramic disc heater units in one embodiment and an electric duct heater in an alternate embodiment.

13 Claims, 5 Drawing Sheets

10
12
14
16
24
26
26a
26b
28
29
30
30A
32
33
34
36
38
68
70
80
A
B
C
2
BOOTH AIR FLOW 68
72
80
74
76
70
28
38
26
26b
26a
41
40
42
29
31
24
32
30
33

WATERBASED CLEARCOAT DRYING APPARATUS

TECHNICAL FIELD

This invention relates generally to apparatus for drying coatings on vehicle instrument panel shells, or the like, and, more particularly, to a "ferris wheel" type drying booth for accomplishing the drying at a high production rate.

BACKGROUND ART

It is well known to use free standing booths for coating parts, such as vehicle instrument panels, which do not contain the capacity or equipment to dry the coating fast enough to maintain acceptable production cycles. This is particularly true where waterbased clearcoat is used, as required by the Clean Air Act to comply with Volatile Organic Compound emission restrictions.

Horizontally mounted wheel or turntable arrangements for spraying paint on selected parts, and washing, drying or transferring same are known, e.g., Padelford U.S. Pat. No. 2,445,451; Barlow et al U.S. Pat. No. 4,556,586; and Arnold et al U.S. Pat. No. 3,306,426.

Ferris wheel type driers are known, e.g., Kretzschmar U.S. Pat. No. 990,749 serves to dry tobacco, with no heat or forced air being utilized; and Frey U.S. Pat. No. 2,327,100 discloses a reel or drum having film strips wound there-around for drying the strips in a stream of heated air.

DISCLOSURE OF THE INVENTION

A general object of the invention is to provide an improved, enclosed ferris wheel and heater arrangement for drying parts such as vehicle instrument panel shells.

Another object of the invention is to provide a drying booth housing a ferris wheel type apparatus adaptable for spraying a waterbased clearcoat on a selected part at a first position, indexing the part 120° to a second position at the top of the circle, beneath a heater assembly suitable for drying the part at a high production rate, i.e., during a predetermined short period of time, say, one minute, and then indexing to a third position for unloading as the immediately following part reaches the heating position.

A further object of the invention is to provide a heater assembly including an electric duct heater mounted at the top of a drying booth wherein a ferris wheel apparatus positions a coated part to be dried directly below, and a process fan for generating air which is warmed by the heater and dispersed through a perforated plate to assure even air flow onto a part to be dried.

A still further object of the invention is to provide an alternate heater assembly, including a plurality of ceramic disc heaters, and adapted to blowing air directly onto the part to be dried for a predetermined minimal period of time, with each heater being individually wired to its own circuit breaker.

These and other objects and advantages will become more apparent when reference is made to the following drawings and the accompanying description.

BEST MODE FOR CARRYING OUT THE INVENTION

Figure 1:
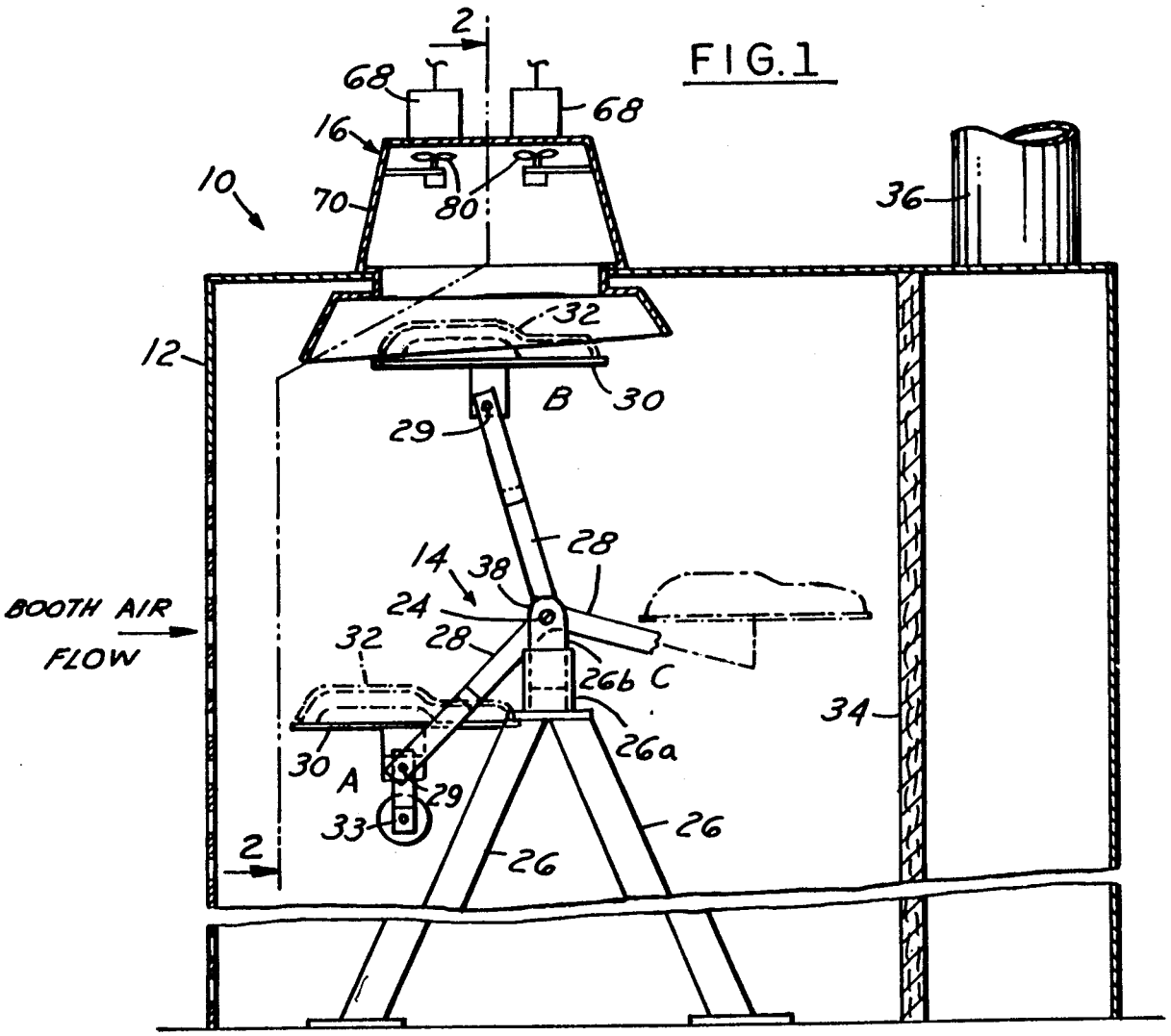
FIG. 1 is a side elevational schematic view of a drying booth, with the side wall thereof removed, and embodying the invention.
Figure 2:
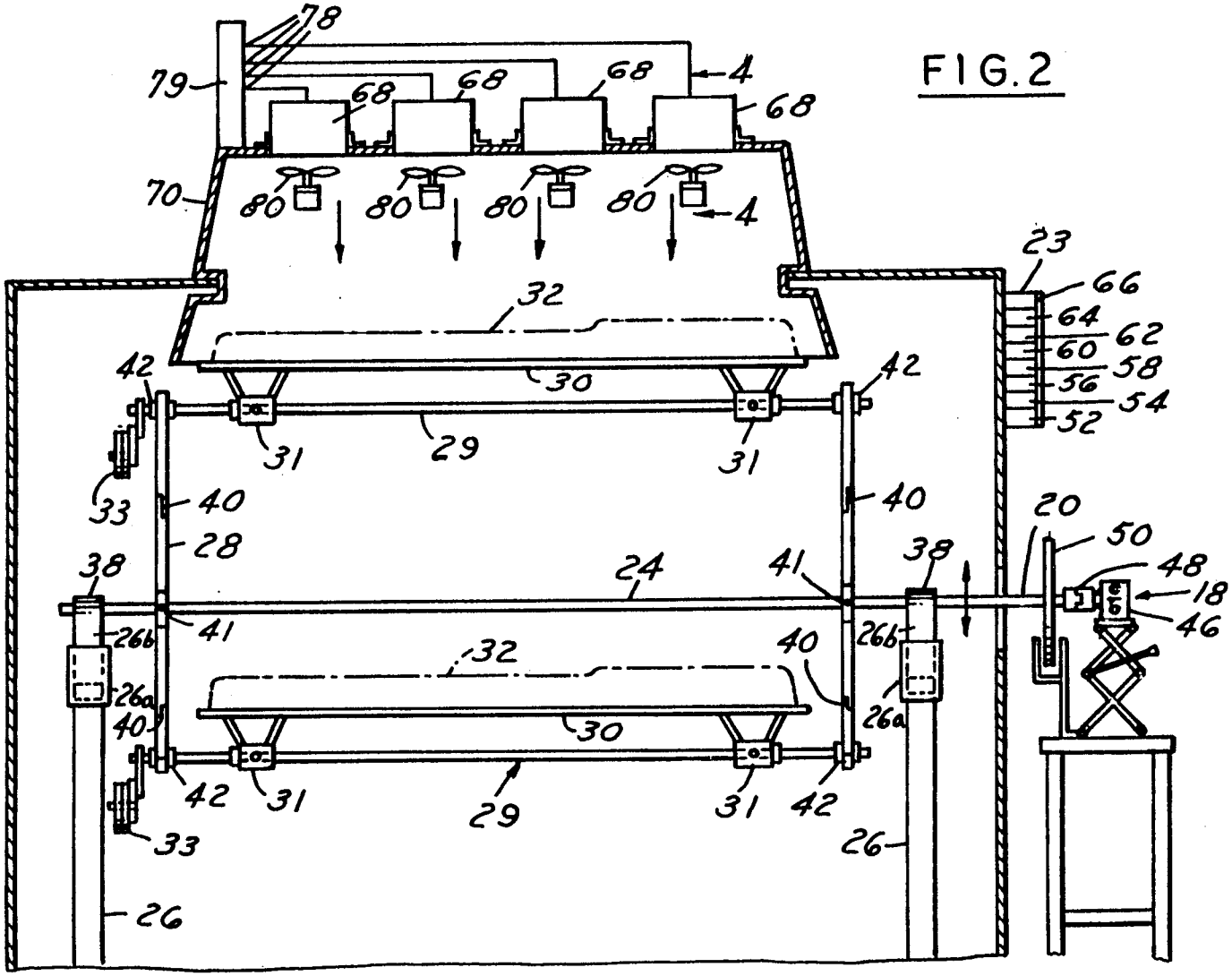
FIG. 2 is a cross-sectional view taken along the plane of the line 2—2 of FIG. 1, and looking in the direction of the arrows.

Referring now to the drawings in greater detail, FIGS. 1 and 2 illustrate generally a ferris wheel type drying booth assembly 10, including a booth 12 having a ferris wheel assembly 14 rotatably mounted therein. A heater assembly 16 is mounted on top of the booth 12. A rotary actuator, clutch and disc brake assembly 18 (FIG. 2) is mounted outside the booth 12 and operably connected by a drive member 20 (FIG. 2) extending therefrom, through a wall 22 of the booth to the ferris wheel assembly 14. A control panel, represented as 23, including suitable controls, is operatively mounted on or adjacent the booth 12. Air flow through the booth 12 is from the left in FIG. 1.

Figures 3, 4:
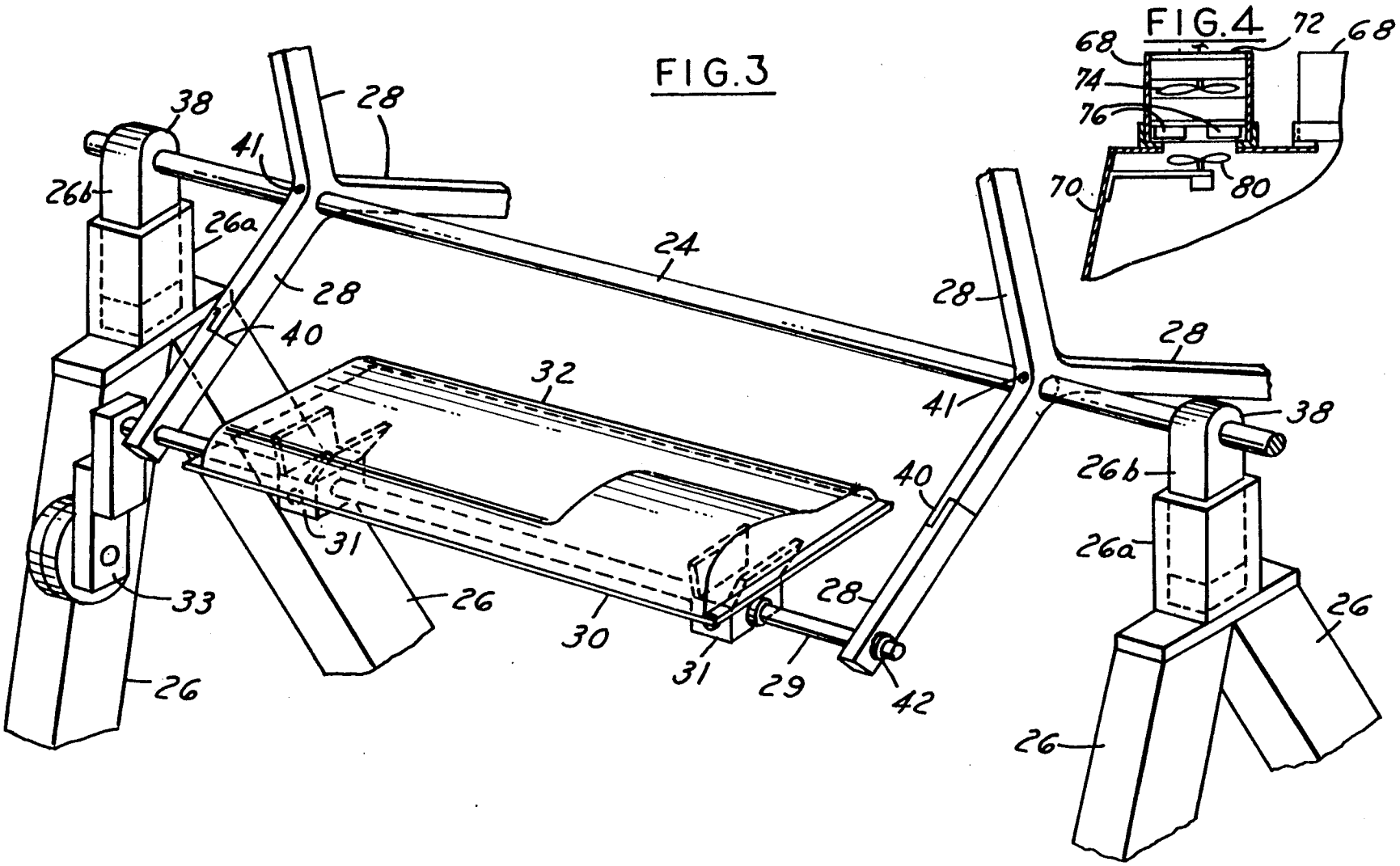
FIG. 3 is an enlarged perspective view of a portion of the FIGS. 1 and 2 structure.
FIG. 4 is a cross-sectional view taken along the plane of the line 4—4, and looking in the direction of the arrows.

The ferris wheel assembly 14 includes a support bar 24 rotatably mounted on support legs 26, a plurality of, say, three, pairs of equally spaced, radially extending arms 28, and a rod 29 having a support plate 30 secured thereto by a suitable connector 31. The rod 29 is pivotally mounted on the distal ends of each pair of arms, each support plate adapted to carrying a part, such as a vinyl instrument panel shell, or the like, represented at 32, to be sprayed and dried. A counterweight 33 is secured to one end of the rod 29. The drive member 20 from the rotary actuator and brake system 18 is connected to the support bar 24 to rotate same and, hence, the respective rod 29 and support plates 30, one hundred and twenty degrees (120°) per index. As indicated in FIGS. 2 and 3, the legs 26 may include telescopic parts **26*a* and 26*b*, to accommodate different height shells 32 on the support plates 30**.

The shells 32 are loaded onto a support plate 30 one at a time at position A and sprayed with a suitable coating material, preferably a waterbased clearcoat. The spraying is accomplished by an operator with a suitable spray gun. The overspray is trapped on filters 34 (FIG. 1) located in the rear of the booth 12, and vapors are exhausted away from the operator and through an exhaust outlet 36. The thus sprayed shell 32 is then rotated through 120° to position B, beneath the heater assembly 16, within a shroud 37, where the shell is dried, as will be explained, after which the assembly 14 is rotated through a second 120° to position C, where the shell continues to dry while a second shell which had been loaded and sprayed at position A is positioned beneath the heater assembly 16 at position B for the next heater cycle. The next index through the third 120° segment returns the shell to position A where it is unloaded and replaced with another shell to be sprayed and dried.

More specifically, the ferris wheel assembly 14 is constructed of aluminum to prevent corrosion and to minimize its weight. The support legs 26 are inverted V-shaped pairs (FIG. 1) supporting the support bar 24 by pillow blocks 38 (FIG. 2), with the three pairs of radial arms 28 secured around the support bar. The radial arms 28 are fabricated from fiberglass and are readily inter-changeable by suitable connectors, represented as 40 in FIG. 2, to accommodate various sizes and shapes of vinyl shells 32. The sets of three arms 28 are secured by suitable fasteners, represented as 41, to the support bar 24.

The support plates 30 are connected to the distal ends of the respective pairs of radial arms 28 by flange blocks (FIG. 2), represented as 42. The counterweight 33 secured to an end of each bar 29 serves to maintain the latter and, hence, the support plate 30 and shell 32, on a horizontal plane, pivoting in the flange blocks 42.

The rotary actuator and brake assembly 18 includes a rotary actuator 46 including an index lock bar and an actuator switch, a single direction clutch 48, and a disc brake 50. In operation, raising the index lock bar trips the air actuator switch. This action signals the disc brake 50 to release, and the rotary actuator 46 to rotate the support bar 24 of the ferris wheel assembly 14 via the drive member 20, along with actuating a timer 52 located in the control panel 23. After the rotation of 120°, the index lock bar locks in place, and the rotary actuator 46 signals the disc brake 50 to stop the rotation, resetting the rotary actuator for the next cycle.

The control panel 23 includes a main disconnect 54, a heater disconnect 56, an emergency stop 58, a heater stop 60, an exhaust blower start switch 62, a heater start switch 64, the timer 52, and suitable control interlocks 66. An indicator light (not shown) may be operatively connected to each of the exhaust blower start switch 62, the heater start switch 64, and the timer 52. For the waterbased clearcoat, the timer 52 is set at one minute for the drying cycle. As such, the timer 52 turns off its indicator light after one minute, indicating to the operator that another shell 32 can be rotated into the drying position beneath the heater assembly 16.

One embodiment of the heater assembly 16 includes a plurality of ceramic disc heaters 68, say eight, assembled in a frame 70 on the top of the spray booth 12 and blowing directly onto the shell 32 directly below. This arrangement is energy efficient in that it does not involve having to heat a large volume of air.

More specifically, as shown in FIG. 4, each disc heater unit 68 includes an air filter 72, a blower 74, and ceramic elements 76. Also, each unit 68 is individually wired to its own circuit breaker 78 (FIG. 2) in a panel 79, and can be unplugged and replaced easily without disturbing the remaining units and without major interruption of production. Each heater unit 68 could be individually controlled to enable a balanced grid of air flow. An air flow indicator, such as a model airplane type propeller 80 (FIG. 4), suspended under each heater unit 68 inside the frame 70 gives an immediate indication if a unit should fail. Specifically, if a propeller 80 stops rotating, indicating no air flow, the associated unit 68 is burned out and should be replaced at the next production break. As the air passes through the ceramic elements 76, the maximum temperature of the elements can be relatively low, say, 325° F., and still supply the needed heat at low energy costs. As the heater units 68 are mounted directly over the product, and the air flow is a direct impingement on the part 32, it is not necessary to use high pressure blowers or high energy duct heaters and related ductwork. Because of the rapid heat response of the ceramic heater elements 76, the heater portion of the units can be turned off between parts and energized only when needed to further save on energy. The blowers can be left on top to provide continuous air flow to keep the heater assembly and shroud clean and free of vapors. A complete drying time of one minute in each of positions B and C is possible with this arrangement.

Figure 5:
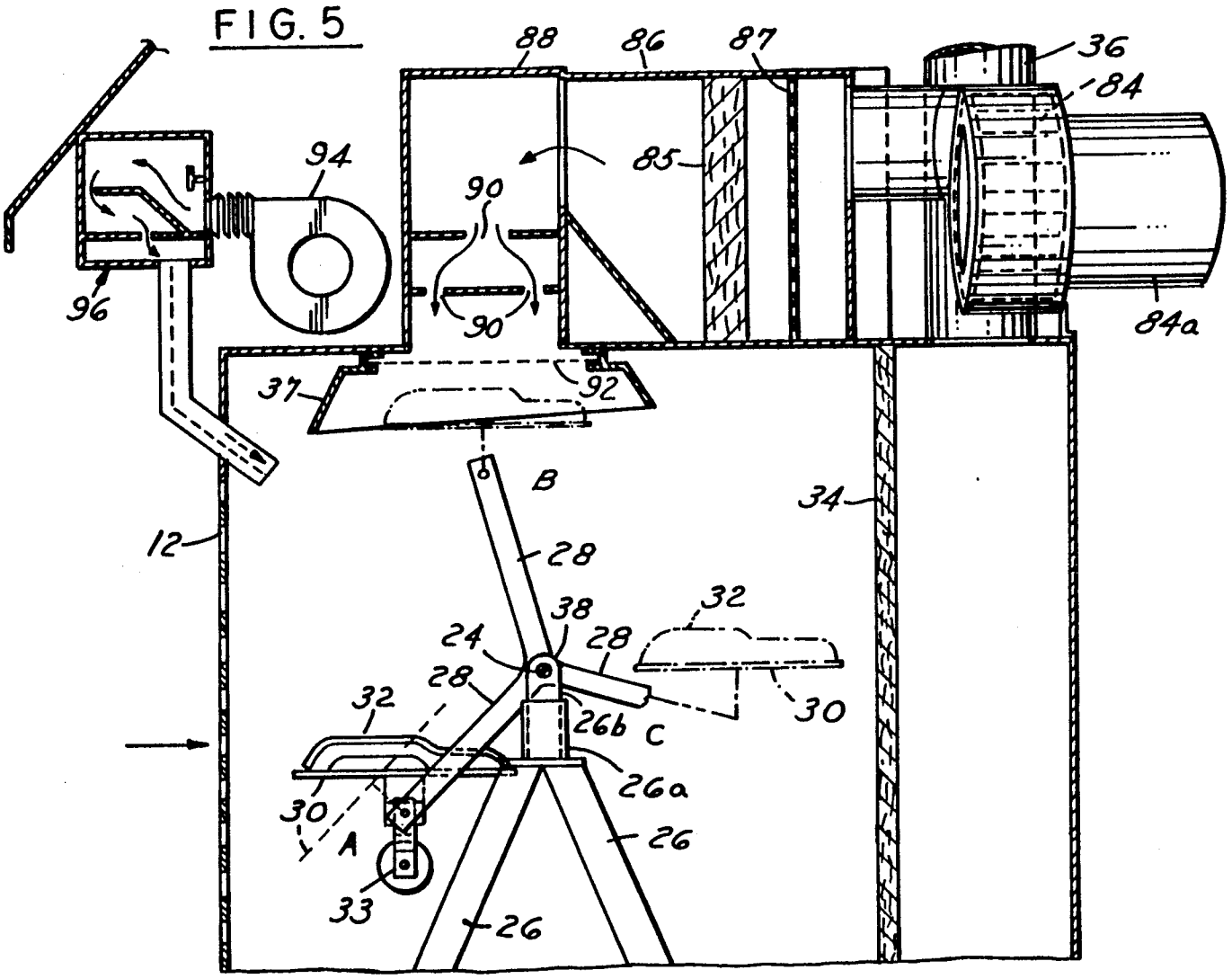
FIG. 5 is a view similar to FIG. 1, illustrating an alternate embodiment of the invention.
Figure 6:
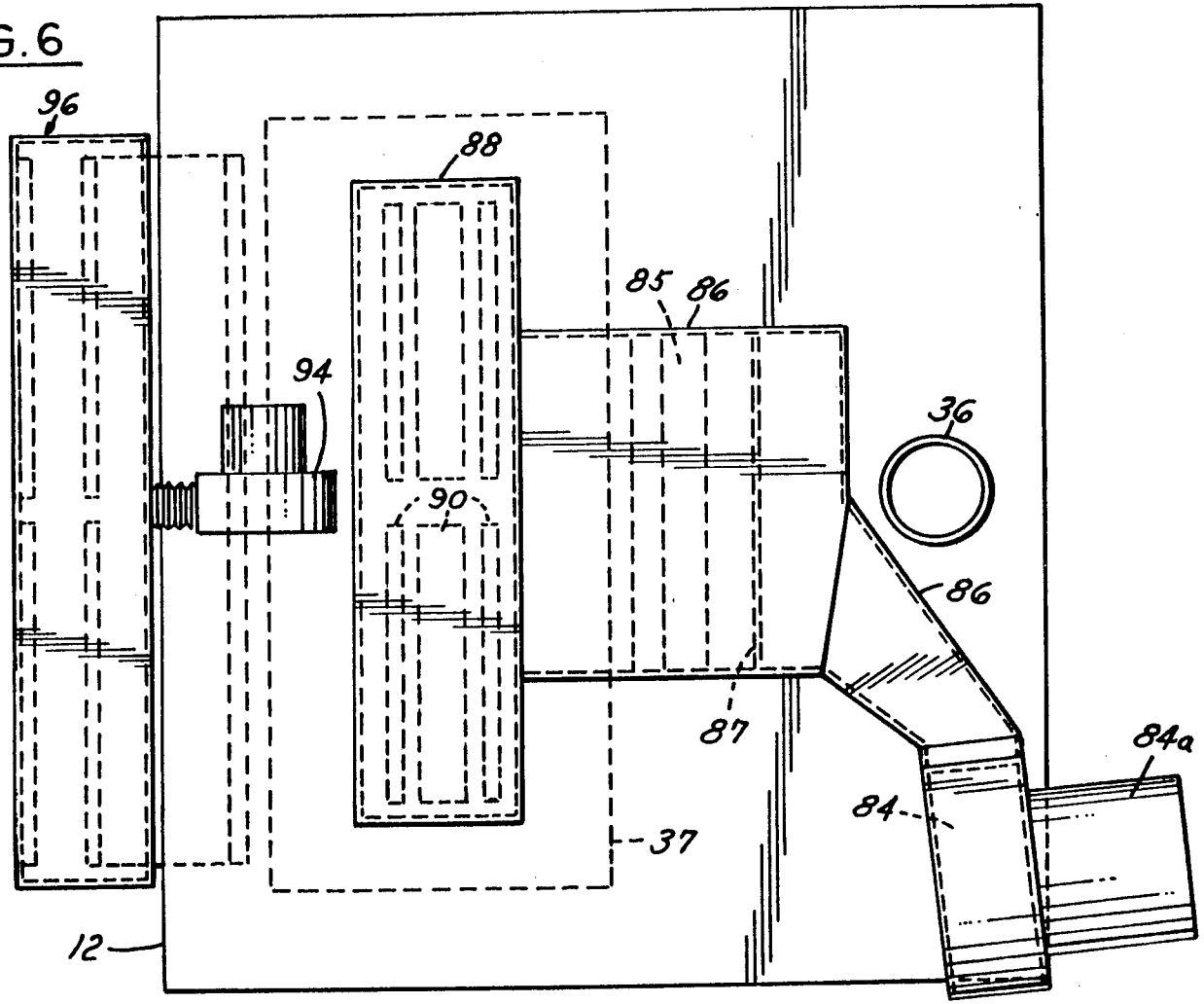
FIG. 6 is a top view of the FIG. 5 structure.

A second embodiment of the heater assembly 16 is shown in FIGS. 5 and 6. This embodiment includes a fan 84, a motor and belt drive **84*a*, an electric duct heater 85 and duct 86, an air distribution plate 87 in the duct 86, a hot air supply plenum 88 including a plurality of predetermined slots 90, and a perforated plate 92 positioned between the outlet of the plenum 88 and the inlet of the shroud 37, for assuring even air flow. Tests have indicated that air maintained at 140° F., and moving continuously at 150 ft/min past position B, effectively dried the respective shells 32** during the allotted one minute time period for each of positions B and C.

A blower 94 and ductwork 96 is mounted on the booth 12, to provide a sheet or plane of air as a barrier to prevent fresh paint spray at position A from reaching and coating previously dried painted parts at position C, prior to their removal from the booth 12.

Industrial Applicability

It should be apparent that the invention provides an enclosed ferris wheel type apparatus for indexing a sprayed part to a drying position, and an externally mounted drying apparatus adaptable to drying the part at a high production rate at that position.

It should be further apparent that once the part to be dried is indexed to a 12:00 position by a ferris wheel type carrier, either a ceramic disk type heater or an electric duct type heater, in conjunction with controlled air flow directed onto the part, is able to dry the part at the high production rate.

While but two embodiments of the invention are shown and described, other modifications thereof are possible within the scope of the following claims.

What is claimed is:

1. A drying apparatus comprising a booth, a ferris wheel rotatably mounted in the booth and including a plurality of equally spaced, radially extending pair of arms, support means operatively connected to the distal ends of each pair of arms for securing a part to be dried thereon, counterweight means operatively connected to each support means for maintaining said support means in a horizontal plane, indexing means operatively connected to said ferris wheel for indexing same through a plurality of indexed positions, and heater means mounted on the top of the booth adapted to heat and direct air downwardly onto each part indexed to a position directly below the heater means for a predetermined length of time to dry the part, wherein said part is loaded on said support means of a first pair of arms at a first position and sprayed with a waterbased clearcoat, indexed to said position below the heater means for receiving the heated air, then indexed to a third position for continuing the drying, and next indexed to a further position to be unloaded from the support mans, and another part loaded at said first position to be sprayed, dried and unloaded.

2. The drying apparatus described in claim 1, wherein said plurality of radially extending pairs of arms is three pairs of arms.

3. The drying apparatus described in claim 1, wherein said heater means includes a plurality of ceramic disc heaters, each including a blower and ceramic elements, and having its own circuit breaker.

4. The drying apparatus described in claim 3, and an air flow indicator positioned in said booth intermediate each said ceramic disc heater and said part being dried.

5. The drying apparatus described in claim 1, wherein said heater means includes a fan, an electric duct heater, a hot air plenum, and a perforated plate for dispersing the warm air evenly onto the part being dried.

6. The drying apparatus described in claim 1, and actuator and brake means including a rotary actuator including a switch and a timer, a single direction clutch, and a disc brake, cooperating to actuate and control the indexing in 120° increments.

7. The drying apparatus described in claim 1, and a shroud mounted in said booth intermediate said heater means and said part being dried.

8. The drying apparatus described in claim 1, and further comprising filters and exhaust means for removing the warm air adjacent said third position.

9. The drying apparatus described in claim 1, wherein said ferris wheel further includes support legs, a support bar rotatably mounted on said support legs, said pairs of arms being secured for rotation with said support bar, and wherein said support means is a plate pivotally mounted on each said pairs of arms, and said counterweight means is secured to an end of said respective plates.

10. The drying apparatus described in claim 1, and further comprising a control panel including a timer, a main disconnect, a heater disconnect, an emergency stop, a heater stop, an exhaust blower start switch, a heater start switch, and suitable control interlocks.

11. The drying apparatus described in claim 1, wherein said predetermined length of drying time is one minute in each of the position directly below the heater means and the third position.

12. The drying apparatus described in claim 1, and further comprising suitable connectors operatively connected to said radially extending pairs of arms adapted to interchange said support means to accommodate various sizes and shapes of said parts to be dried.

13. The drying apparatus described in claim 9, wherein said support legs are adjustable in height.

* * * * *